United States Patent [19]

Axelson et al.

[11] Patent Number: 5,069,136

[45] Date of Patent: Dec. 3, 1991

[54] TWO-STAGE RELEASE MECHANISM AND METHOD FOR SELF-RIGHTING A LOAD

[75] Inventors: Eric T. Axelson, Minnetonka; Thomas P. Mathews, Plymouth, both of Minn.

[73] Assignee: Honeywell Inc., Minneapolis, Minn.

[21] Appl. No.: 582,566

[22] Filed: Sep. 14, 1990

[51] Int. Cl.[5] ..... F42B 23/24

[52] U.S. Cl. ..... 102/425; 102/400; 102/401

[58] Field of Search ..... 102/425, 424, 401, 400, 102/393, 382, 404

[56] References Cited

U.S. PATENT DOCUMENTS

| | | | |
|---|---|---|---|
| 3,765,335 | 10/1973 | Blair et al. | 102/400 |
| 4,922,824 | 5/1990 | Schubart | 102/425 |
| 4,934,271 | 6/1990 | Kensok et al. | 102/401 |
| 4,934,274 | 6/1990 | Mathey | 102/425 |

FOREIGN PATENT DOCUMENTS

| | | | |
|---|---|---|---|
| 0069914 | 1/1983 | European Pat. Off. | 102/425 |
| 3127071 | 1/1983 | Fed. Rep. of Germany | 102/401 |
| 3730546 | 1/1989 | Fed. Rep. of Germany | 102/401 |
| 8907234 | 8/1989 | Int'l Pat. Institute | 102/382 |
| 2101280 | 1/1983 | United Kingdom | 102/401 |

*Primary Examiner*—David H. Brown

*Attorney, Agent, or Firm*—Merchant, Gould, Smith, Edell, Welter & Schmidt

[57] ABSTRACT

A two-stage release self-righting mechanism and method employ a pair of primary and secondary releasable holder assemblies which respective hold upper and middle portions of leaf spring arms in a stowed position against the side wall of a load such as a submunition launcher tube. The primary holder assembly is released first which permits release of a portion of the energy stored by the spring legs, causing them to partially extend from the stowed position to a partially deployed position and partially erect the submunition. Then, a short time later, the secondary holder assembly is released, permitting release of the remaining energy stored by the spring legs, causing them to fully extend to a fully deployed position and complete the erecting of the submunition.

13 Claims, 3 Drawing Sheets

TWO-STAGE RELEASE MECHANISM AND METHOD FOR SELF-RIGHTING A LOAD

BACKGROUND OF THE INVENTION

The Government has rights in this invention pursuant to Contract No. DAAA21-87-C-0201, awarded by the Department of the Army.

FIELD OF THE INVENTION

The present invention generally relates to erecting a load from a laying down side position to an upright position and, more particularly, is concerned with a two-stage release mechanism and method for self-righting a load.

DESCRIPTION OF THE PRIOR ART

A wide area mine (WAM) submunition is currently being developed for the U.S. military. The WAM (also termed a "smart" mine) submunition basically includes a noise sensor that can detect sounds, or an acoustic signature, of a moving target, a launcher tube containing a sublet, a positioning mechanism for aiming the launcher tube, and an arming and firing mechanism for launching the sublet from the launcher tube.

The WAM submunition is initially deployed in a target area in a laying down or side position on the ground. Thus, the WAM submunition also has a self-righting mechanism used to erect the launcher tube from the side position to an upright position prior to final arming. After erecting the launcher tube, the self-righting mechanism stabilizes the submunition in the upright position while maintaining it coupled with the ground.

The self-righting mechanism is composed of a base member attached to the base of the aiming and positioning mechanism of the submunition and an array of leaf spring legs circumferentially spaced from one another about the side wall of the launcher tube and attached to the base member and extending from the bottom to top edge of the launcher tube. The spring legs are fabricated to normally assume outwardly and downwardly inverted U-shaped configurations in a fully deployed position of the self-righting mechanism in which the tips of the spring legs contact the ground spaced outwardly from the base of the submunition. The spring legs are initially held in straightened or flat configurations in a fully stowed position of the self-righting mechanism by a releasable holder assembly which encircles the top end of the launcher tube and holds the upper ends of the spring legs against the launcher tube.

At the desired moment, the holder assembly is actuated to release the spring legs. The spring legs then automatically curl outwardly and downwardly to assume their inverted U-shaped configurations in the fully deployed position. As the spring legs curl outward and downward toward their inverted U-shaped configurations, they push against the ground moving the submunition launcher tube toward the upright position. The spring legs thus provide the energy required to bring the submunition from the down or side position to the upright position. Heretofore, such release and deployment of the spring legs has been a single stage operation.

For the self-righting mechanism to be an effective way to erect and stabilize the submunition, it must be capable of satisfactorily uprighting the submunition on sloped ground as well as flat or level ground. One difficulty with the self-righting mechanism is that the spring legs must be designed with high enough energy output to erect the submunition going up slope, but yet have a low enough energy output to erect the submunition when going down slope without flipping it over. In the single stage operation of the spring legs from the stowed to deployed position of the self-righting mechanism, the energy released by the spring legs is uncontrollable to the point where the submunition will frequently flip over during righting on ground slopes of up to fifteen degrees when trying to erect it going downhill.

Attempts to prevent flipping when erecting the submunition downhill on slopes up to fifteen degrees by redesign of the self-righting spring legs have failed. Consequently, a need exists for a different approach to control of the energy released by the self-righting spring legs to improve reliability of the mechanism in diverse terrain conditions.

SUMMARY OF THE INVENTION

The present invention provides a two-stage release self-righting mechanism and method designed to satisfy the aforementioned needs. The two-stage release mechanism adds a second releasable holder assembly to the single-stage release mechanism of the prior art at a desired location, such as approximately midway, between the top and bottom edges of a load, such as the launcher tube.

Accordingly, the present invention is directed to a two-stage release self-righting mechanism and method which employ a pair of primary top and secondary intermediate releasable holder assemblies that respectively hold upper and intermediate portions of leaf spring arms in a stowed position against the side wall of a load such as a submunition launcher tube. The primary holder assembly is released first which permits release of a portion of the energy stored by the spring legs, causing them to partially extend from the stowed position to a partially deployed position and partially erect the submunition. Then, a short time later, the secondary holder assembly is released, permitting release of the remaining energy stored by the spring legs, causing them to fully extend to a fully deployed position and complete the erecting of the submunition.

Most of the stored energy of the spring legs of the self-righting mechanism is released when the primary holder assembly is released. The remaining stored energy in the spring legs is just enough to upright the submunition going uphill and downhill without flipping the submunition over.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Prior Art Self-Righting Mechanism

Figure 1:
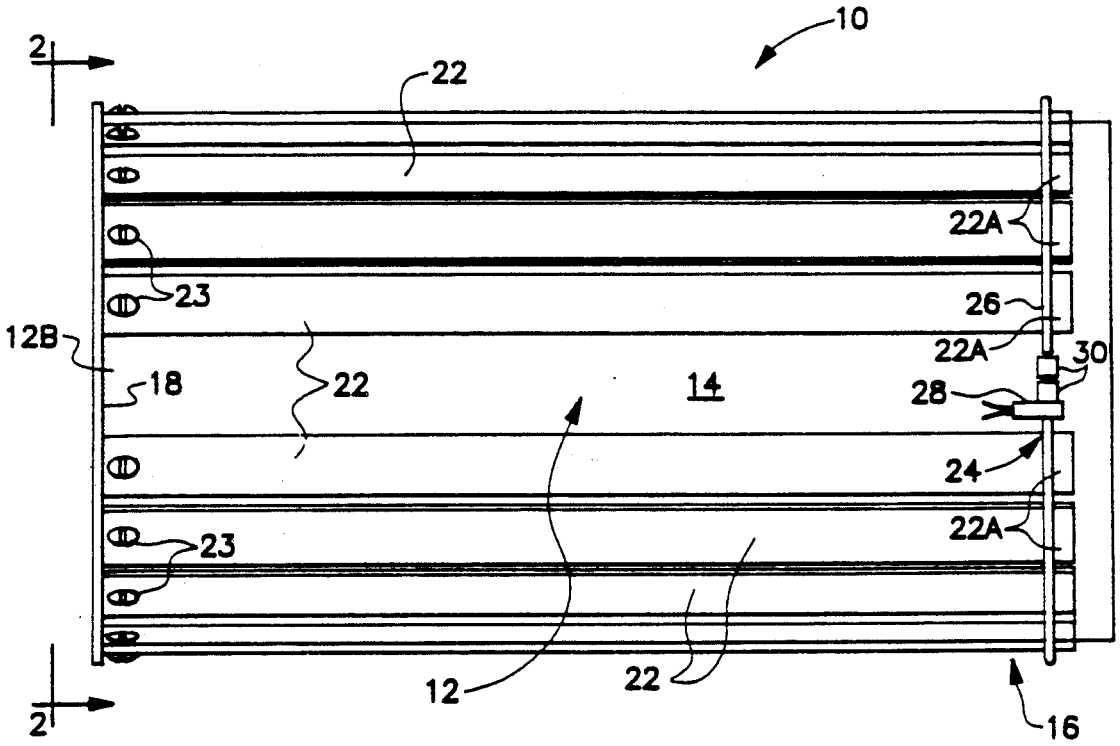
Fig. 1 (Prior Art)
FIG. 1 is a side elevational view of a prior art self-righting mechanism.
Figure 2:
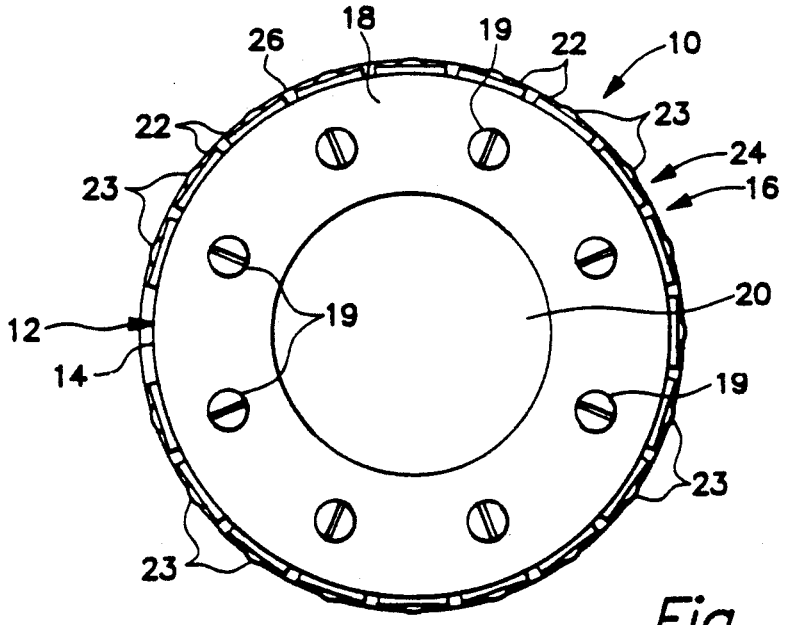
Fig. 2 (Prior Art)
FIG. 2 is an end elevational view of the mechanism as seen along line 2—2 of FIG. 1.
Figure 3A:
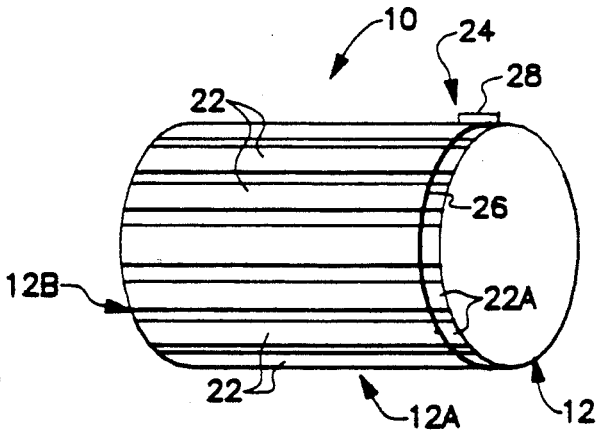
Fig. 3A (Prior Art)
FIGS. 3A and 3B are schematic representations of the single-stage self-righting sequence of the prior art self-righting mechanism of FIG. 1.
Figure 3B:
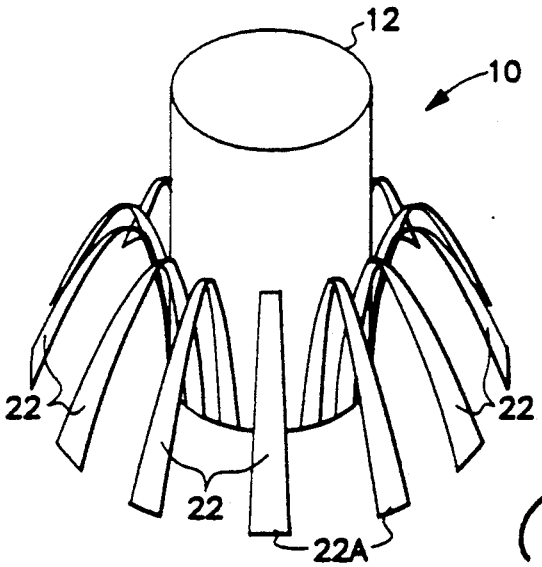
Fig. 3B (Prior Art)

Referring to the drawings, and particularly to FIGS. 1 and 2, there is shown an elongated load 10, such as a launcher tube 12 of a submunition having a cylindrical side wall 14. The submunition 10 incorporates a prior art self-righting mechanism 16 operable to erect the launcher tube 12 from a laying down or side position, as seen in FIG. 3A, in which the launcher tube 12 rests on its side 12A, to an upright position, as seen in FIG. 3B, in which the tube 12 rests on its bottom or base 12B.

Referring to FIGS. 1 and 2, the self-righting mechanism 16 basically includes a mounting base member 18 in the form of an annular plate attached by fasteners 19 to the bottom surface 20 of the base 12B of the launcher tube 12 and an array of resiliently flexible legs 22 in the form of leaf springs being spaced circumferentially from one another about the side wall 14 of the launcher tube 12 and rigidly attached to the periphery of the annular base plate 18. The spring legs 22 are also attached by fasteners 23 to the tube side wall 14 adjacent its lower edge and extend from substantially the bottom to top edge of the launcher tube 12. The spring legs 22 are fabricated to normally assume outwardly and downwardly inverted U-shaped configurations so that the self-righting mechanism 10 is biased to assume a fully deployed position, as seen in FIG. 3B, in which the tip ends 22A of the spring legs 22 contact the ground in outwardly spaced relation from the base of the submunition.

The self-righting mechanism 16 further includes a releasable holder assembly 24 for holding the spring legs 22 in straightened or flat configurations to define a fully stowed position of the self-righting mechanism. The holder assembly 24 of the mechanism 16 is made up of an elongated flexible multi-stranded metal wire or cable 26 which encircles the top end of the launcher tube 12 and holds the tip ends 22A of the spring legs 22 against the side wall 14 of the launcher tube 12. The holder assembly 24 further has a release device 28 and a cable connector 30 interposed in the cable 26. The cable connector 30 is merely connected sleeves crimped to the opposite ends of the cable 26. The release device 28 can be any suitable means actuatable for rupturing or severing the cable 26 when desired. One suitable form of the release device 28 employs a plunger wedge which is driven by a pyrotechnic element that is activated electrically.

At the desired moment, the release device 28 of the holder assembly 24 is activated to sever the cable 26 and release the spring legs 22. The released spring legs 22 then automatically curl outwardly and downwardly from their flat configurations of the fully stowed position of the mechanism 16 shown in FIG. 3A to assume their inverted U-shaped configurations in the fully deployed position of the mechanism 16 shown in FIG. 3B. As the spring legs 22 curl outward and downward toward their inverted U-shaped configurations, their tip ends 22A engage and push against the ground lifting the launcher tube 12 toward the upright position.

Thus, the spring legs 22 provide the energy required to lift the submunition 10 from the laying down side position of FIG. 3A to the upright position of FIG. 3B. Heretofore, such release and deployment of the spring legs has been accomplished in a single-stage release operation. As mentioned earlier, the difficulty has been that the energy released by the spring legs during the single-stage release operation will cause the submunition 10 to accelerate too rapidly and flip over during righting on ground slopes of up to fifteen degrees when trying to erect it going downhill.

Self-Righting Mechanism of Present Invention

Figure 4:
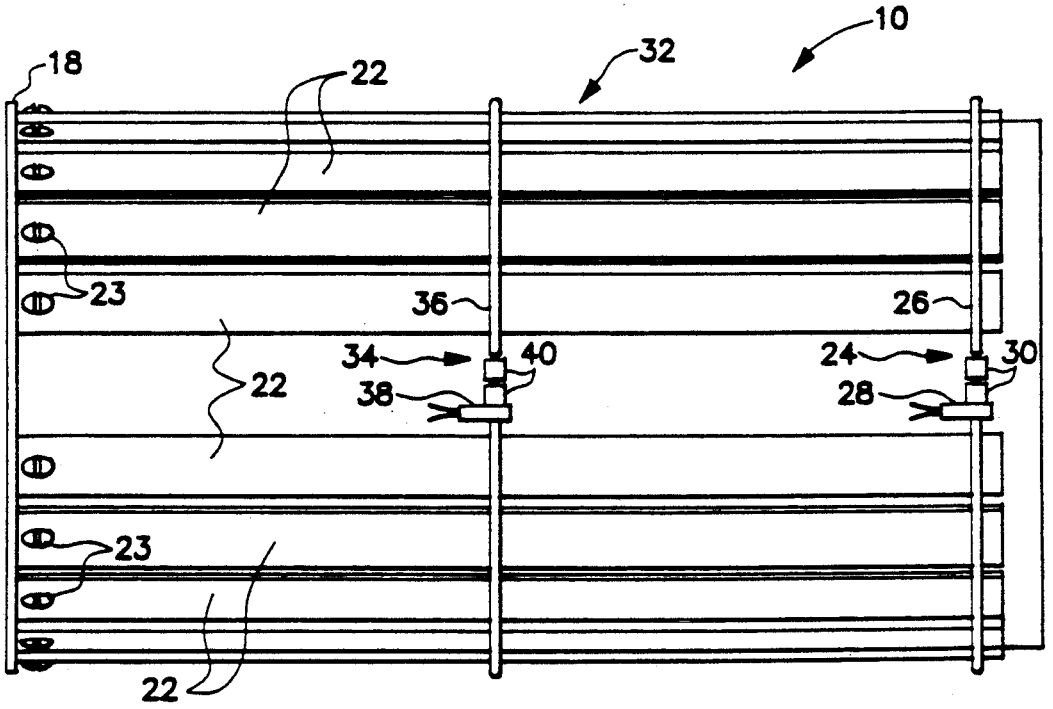
FIG. 4 is a side elevational view of a self-righting mechanism of the present invention.

Referring to FIG. 4, there is shown a construction of a self-righting mechanism 32 in accordance with the present invention which satisfactorily compensates for this difficulty. The mechanism 32 of the present invention includes the components of the prior art self-righting mechanism 16 as described above. In accordance with the principles of the present invention, the self-righting mechanism 32 adds a secondary intermediate releasable holder assembly 34, substantially identical in construction to the primary top releasable holder assembly 24, at a preselected location, such as approximately midway, between the top and bottom edges of the launcher tube 12. The secondary intermediate holder assembly 24 transforms the single-stage release mechanism 16 of the prior art into a two-stage release mechanism 32 of the present invention.

As in the case of the primary top holder assembly 24, the secondary intermediate holder assembly 34 of the mechanism 32 also is made up of an elongated flexible stranded metal wire or cable 36 which encircles the middle of the launcher tube 12 and holds the middle portions of the spring legs 22 against the side wall 14 of the launcher tube 12. The secondary holder assembly 34 further has a release device 38 and a cable connector 40 interposed in the cable 26 crimping the opposite ends of the cable 36 to one another. The release device 38 can be activated to rupture or severe the cable 36 when desired.

Figure 5A:
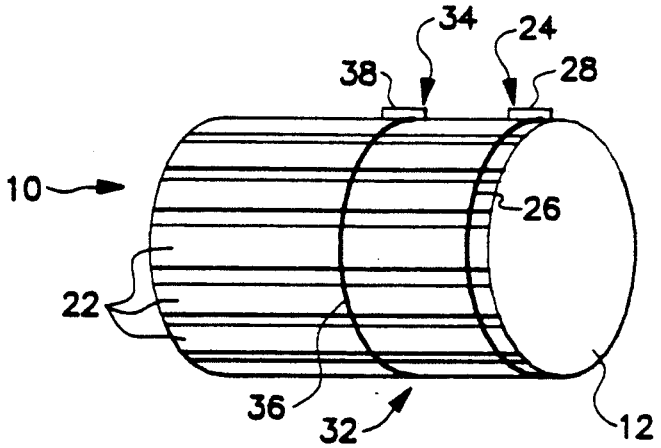
FIGS. 5A, 5*b* and 5C are schematic representations of the two-stage self-righting sequence of the self-righting mechanism of FIG. 4.
Figure 5B:
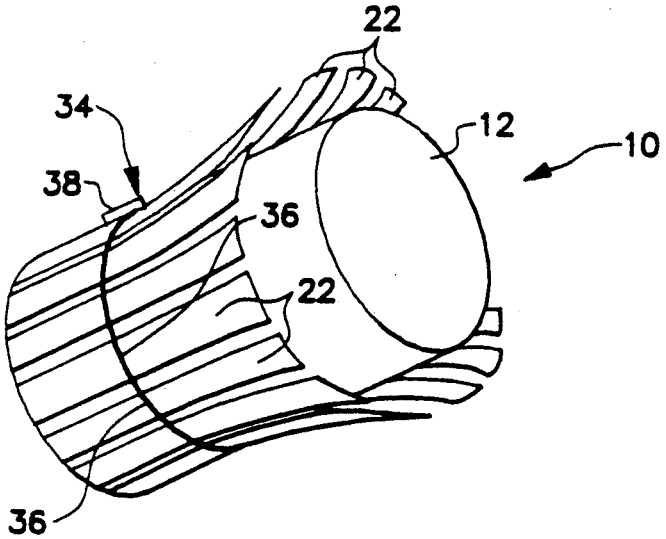
Figure 5C:
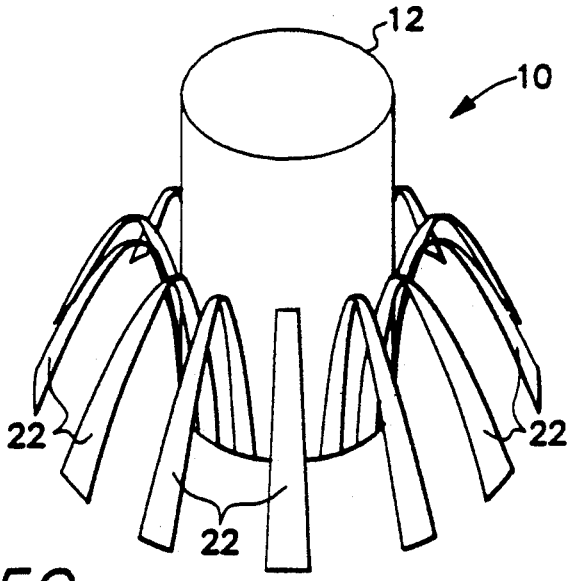

Referring to FIGS. 5A, 5B and 5C, the two-stage release method employed by the self-righting mechanism 32 of the present invention includes the release of the primary holder assembly 24 first which permits release of a portion of the stored energy of the spring legs 22, causing them to partially extend from the stowed position of FIG. 5A to the partially deployed position of FIG. 5B and partially erect the submunition 10. Then, a short time later, for example ten seconds, the secondary holder assembly 34 is released, permitting release of the remaining stored energy of the spring legs 22, causing them to fully extend to the fully deployed position of FIG. 5C and complete the erecting of the submunition 10.

Most of the stored energy of the spring legs 22 of the self-righting mechanism 32 is released when the primary holder assembly 24 is released. The remaining stored energy in the spring legs 22 is just enough to upright the submunition 10 going uphill and downhill without flipping the submunition over. The position of the secondary holder assembly 34 can be readily adjusted merely by moving it up or down on the launcher tube side wall 14. In such manner the submunition weight and center of gravity location are taken into account so that any size submunition can employ the two-stage release self-righting mechanism 32 of the present invention.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A two-stage release self-righting mechanism for use in erecting a load from a side position to an upright position, said mechanism comprising:

(a) an array of spring legs for attachment to the load and extending in circumferentially spaced relation to one another, said spring legs being yieldably and resiliently flexible from a fully deployed position to a fully stowed position for storing energy when disposed at said stowed position; and (b) a pair of primary and secondary releasable holder assemblies for holding upper and intermediate portions of said spring legs in said fully stowed position against the load such that release of said primary holder assembly releases an initial portion of energy stored by said spring legs so as to cause them to partially extend from said stowed position to a partially deployed position and partially erect the load, whereas release of said secondary holder assembly a predetermined period of time after release of said primary holder assembly releases a remaining portion of energy stored by said spring legs so as to cause them to fully extend to said fully deployed position and complete the erecting of the load.

2. The mechanism of claim 1 wherein said spring legs have generally inverted U-shaped configurations when in said fully deployed position.

3. The mechanism of claim 1 wherein said spring legs have generally parallel straightened configurations when in said fully stowed position.

4. The mechanism of claim 1 wherein said secondary holder assembly is positioned along said spring legs so that said spring legs release a greater amount of stored energy in extending from said stowed position to said partially deployed position than in extending from said partially deployed position to said fully deployed position.

5. The mechanism of claim 1 wherein each of said holder assemblies includes a cable for encircling said spring legs at said upper and intermediate portions thereof.

6. The mechanism of claim 5 wherein each of said holder assemblies includes a release device attached to said cable and being activatable to rupture said cable for releasing each of said holder assemblies.

7. In combination with a load having a base and a side wall, a two-stage release self-righting mechanism being operable for erecting the load from a side portion to an upright position, said mechanism comprising:

(a) an array of spring legs attached at lower portions to said base of said load and extending in circumferentially spaced relation to one another, said spring legs being yieldably and resiliently flexible from generally inverted U-shaped configurations when disposed in a fully stowed position to generally parallel straightened configurations when disposed in a fully deployed position;

(b) a first holder assembly encircling said spring legs at upper portions thereof and holding said legs against said load side wall in said straightened configurations and said fully stowed position, said first holder assembly including a release device for releasing said first holder assembly from said spring legs for permitting said legs to curl outwardly and downwardly toward said inverted U-shaped configurations and contact and push against the ground to initiate erecting of said load from its side to upright position; and (c) a second holder assembly encircling said spring legs at intermediate portions thereof located between said lower and upper portions thereof and holding said intermediate portions of said legs against said load side wall while allowing said upper portions of said legs to curl away from said load side wall and reach a partially deployed position, said second holder assembly including a release device for releasing said second holder assembly from said spring legs for permitting said lower portions of said legs to continue curling outwardly and downwardly to said inverted U-shaped orientations and reach said fully deployed position in which ends of said spring legs contact the ground at locations spaced outwardly from and about said base of said load for completing erecting of said load to its upright position.

8. The mechanism of claim 7 wherein said spring legs release a greater amount of stored energy in extending from said stowed position to said partially deployed position than in extending from said partially deployed position to said fully deployed position.

9. The mechanism of claim 7 wherein each of said holder assemblies includes a cable for encircling said spring legs at said respective upper and intermediate portions thereof.

10. A two-stage release self-righting method for erecting a load from a side position to an upright position, said method comprising the steps of:

(a) attaching an array of spring legs to the load such that said spring legs extend in circumferentially spaced relation to one another along a side wall of the load, said spring legs being yieldably and resiliently flexible from a fully deployed position to a fully stowed position for storing energy when disposed at said stowed position;

(b) holding said spring legs at upper and intermediate portions thereof in said fully stowed position against the load;

(c) releasing said spring legs at said upper portions thereof to release an initial portion of energy stored by said spring legs and cause them to partially extend from said stowed position to a partially deployed position and partially erect the load; and (d) releasing said spring leg s at said intermediate portions thereof a predetermined period of time after release of said spring legs as said upper portions thereof to release the remaining portion of energy stored by said spring legs and cause them to fully extend to said fully deployed position and complete the erecting of the load.

11. The method of claim 10 wherein said holding of said spring legs at said upper portions thereof in said fully stowed position against the load includes encircling a side wall of the load and said upper portions of said spring legs with a primary releasable holder assembly.

12. The method of claim 11 wherein said holding of said spring legs at said intermediate portions thereof in said fully stowed position against the load includes encircling the side wall of the load and said intermediate portions of said spring legs with a secondary releasable holder assembly.

13. The method of claim 12 further comprising:

varying the initial portion of energy released by relocating said secondary releasable holding assembly along the side wall of the load and said intermediate portions of said spring legs.

* * * * *